US008181879B2

(12) United States Patent
Landau et al.

(10) Patent No.: US 8,181,879 B2
(45) Date of Patent: May 22, 2012

(54) MAILING APPARATUS FOR POWERED CARDS

(75) Inventors: Steven Landau, Oldsmar, FL (US); Teresa Taylor, Melbourne, FL (US)

(73) Assignee: Solicore, Inc., Lakeland, FL (US)

( * ) Notice: Subject to any disclaimer, the term of this patent is extended or adjusted under 35 U.S.C. 154(b) by 219 days.

(21) Appl. No.: 11/966,026

(22) Filed: Dec. 28, 2007

(65) Prior Publication Data

US 2008/0156690 A1 Jul. 3, 2008

Related U.S. Application Data

(60) Provisional application No. 60/877,634, filed on Dec. 29, 2006.

(51) Int. Cl.
*G06K 19/00* (2006.01)

(52) U.S. Cl. ..... 235/487; 235/492; 235/495; 206/39; 206/232; 206/307; 150/131; 150/147

(58) Field of Classification Search ..... 235/487, 235/492, 495; 206/39, 232, 307; 150/131, 150/147

See application file for complete search history.

(56) References Cited

U.S. PATENT DOCUMENTS

| | | | | |
|---|---|---|---|---|
| 3,773,251 | A | | 11/1973 | Hadick |
| 3,999,700 | A | | 12/1976 | Chalmers |
| 4,055,014 | A | | 10/1977 | Schmidt et al. |
| 4,286,399 | A | | 9/1981 | Funahashi et al. |
| 4,299,041 | A | | 11/1981 | Wilson |
| 4,450,955 | A | * | 5/1984 | Featherston ..... 206/39.6 |
| 4,575,621 | A | | 3/1986 | Dreifus |
| 4,607,747 | A | | 8/1986 | Steiner |
| 4,614,861 | A | | 9/1986 | Pavlov et al. |
| 4,667,087 | A | | 5/1987 | Quintanat |
| 4,680,724 | A | | 7/1987 | Sugiyama et al. |
| 4,689,478 | A | | 8/1987 | Hale et al. |
| 4,692,601 | A | | 9/1987 | Nakano |
| 4,701,601 | A | | 10/1987 | Francini |
| 4,707,594 | A | | 11/1987 | Roth |
| 4,719,453 | A | | 1/1988 | Beck et al. |
| 4,726,771 | A | | 2/1988 | Weinblatt |
| 4,728,978 | A | | 3/1988 | Inoue et al. |

(Continued)

FOREIGN PATENT DOCUMENTS

JP 06-191182 7/1994

(Continued)

OTHER PUBLICATIONS

International Search Rpt. & Written Opinion, Mar. 3, 2008.

(Continued)

*Primary Examiner* — Ali Sharifzada
(74) *Attorney, Agent, or Firm* — Morris, Manning & Martin, LLP; Christopher W. Raimund

(57) ABSTRACT

Apparatuses and methods for packaging electronically powered cards are provided for maintaining electronically powered cards in a deactivated state. In an embodiment, a housing having a face panel and two side panels attached to the face panel at opposite sides is configured to provide an offset distance between an activation device on the card and the housing so that the activation device is prevented from being activated by a force exerted on the housing. Annular or circular devices can also be provided for establishing an offset distance between activation devices on the card and planar substrates.

13 Claims, 5 Drawing Sheets

U.S. PATENT DOCUMENTS

| | | | | |
|---|---|---|---|---|
| 4,749,982 | A | | 6/1988 | Rikuna et al. |
| 4,754,418 | A | | 6/1988 | Hara |
| 4,755,660 | A | | 7/1988 | Nakano |
| 4,764,666 | A | | 8/1988 | Bergeron |
| 4,794,236 | A | | 12/1988 | Kawana |
| 4,797,542 | A | | 1/1989 | Hara |
| 4,800,255 | A | | 1/1989 | Imran |
| 4,812,634 | A | | 3/1989 | Ohta et al. |
| 4,827,111 | A | | 5/1989 | Kondo |
| 4,829,166 | A | | 5/1989 | Froelich |
| 4,837,422 | A | | 6/1989 | Dethloff |
| 4,864,115 | A | | 9/1989 | Imran et al. |
| 4,868,376 | A | | 9/1989 | Lessin et al. |
| 4,876,441 | A | | 10/1989 | Hara et al. |
| 4,879,455 | A | | 11/1989 | Butterworth et al. |
| 4,884,092 | A | | 11/1989 | Inoue et al. |
| 4,887,115 | A | | 12/1989 | Inoue et al. |
| 4,916,434 | A | | 4/1990 | McNeely |
| 4,918,631 | A | | 4/1990 | Hara et al. |
| 4,924,075 | A | | 5/1990 | Tanaka |
| 4,939,326 | A | | 7/1990 | Weinblatt |
| 4,968,873 | A | | 11/1990 | Dethloff et al. |
| 5,001,775 | A | | 3/1991 | Hayashi et al. |
| 5,010,237 | A | | 4/1991 | Kawana |
| 5,017,766 | A | | 5/1991 | Tamada et al. |
| 5,025,373 | A | | 6/1991 | Keyser et al. |
| 5,072,103 | A | | 12/1991 | Nara |
| 5,081,482 | A | | 1/1992 | Miki et al. |
| 5,134,434 | A | | 7/1992 | Inoue et al. |
| 5,177,789 | A | | 1/1993 | Covert |
| 5,180,902 | A | | 1/1993 | Schick |
| 5,181,744 | A | | 1/1993 | Betheil |
| 5,192,947 | A | | 3/1993 | Neustein |
| 5,193,275 | A | | 3/1993 | Hirokazu et al. |
| 5,209,665 | A | | 5/1993 | Billings et al. |
| 5,245,171 | A | | 9/1993 | Fox et al. |
| 5,267,218 | A | | 11/1993 | Elbert |
| 5,297,205 | A | | 3/1994 | Audebert et al. |
| 5,317,636 | A | | 5/1994 | Vizcaino |
| 5,343,519 | A | | 8/1994 | Feldman |
| 5,350,945 | A | | 9/1994 | Hayakawa |
| 5,373,283 | A | | 12/1994 | Maharshak |
| 5,399,021 | A | * | 3/1995 | Litt ..... 383/5 |
| 5,399,847 | A | | 3/1995 | Droz |
| 5,412,192 | A | | 5/1995 | Hoss |
| 5,412,199 | A | | 5/1995 | Finkelstein et al. |
| D359,305 | S | | 6/1995 | Finkelstein |
| 5,433,035 | A | | 7/1995 | Bauer |
| 5,434,398 | A | | 7/1995 | Goldberg |
| 5,434,405 | A | | 7/1995 | Finkelstein et al. |
| 5,449,994 | A | | 9/1995 | Armand et al. |
| 5,450,491 | A | | 9/1995 | McNair |
| 5,451,763 | A | | 9/1995 | Pickett et al. |
| 5,452,352 | A | | 9/1995 | Talton |
| 5,457,613 | A | | 10/1995 | Vandenbelt et al. |
| 5,465,082 | A | | 11/1995 | Chaco |
| 5,484,997 | A | | 1/1996 | Haynes |
| 5,520,544 | A | | 5/1996 | Manico et al. |
| 5,529,503 | A | | 6/1996 | Kerklaan |
| 5,530,235 | A | | 6/1996 | Stefik et al. |
| 5,539,819 | A | | 7/1996 | Sonoyama et al. |
| 5,580,794 | A | | 12/1996 | Allen |
| 5,583,933 | A | | 12/1996 | Mark |
| 5,585,618 | A | | 12/1996 | Droz |
| 5,585,787 | A | | 12/1996 | Wallerstein |
| 5,590,038 | A | | 12/1996 | Pitroda |
| 5,608,203 | A | | 3/1997 | Finkelstein et al. |
| 5,636,271 | A | | 6/1997 | Paterno et al. |
| 5,641,164 | A | | 6/1997 | Doederlein et al. |
| 5,642,095 | A | | 6/1997 | Cook |
| 5,652,838 | A | | 7/1997 | Lovett et al. |
| 5,671,271 | A | | 9/1997 | Henderson et al. |
| 5,676,307 | A | | 10/1997 | Martin |
| D387,802 | S | | 12/1997 | Finkelstein et al. |
| 5,741,392 | A | | 4/1998 | Droz |
| 5,743,801 | A | | 4/1998 | Welander |
| 5,745,555 | A | | 4/1998 | Mark |
| 5,748,082 | A | | 5/1998 | Payne |
| 5,748,737 | A | | 5/1998 | Daggar |
| 5,749,735 | A | | 5/1998 | Redford et al. |
| 5,767,896 | A | | 6/1998 | Nemirofsky |
| 5,777,305 | A | * | 7/1998 | Smith et al. ..... 235/380 |
| 5,777,903 | A | | 7/1998 | Piosenka et al. |
| 5,778,076 | A | | 7/1998 | Kara et al. |
| 5,789,732 | A | | 8/1998 | McMahon et al. |
| 5,790,027 | A | | 8/1998 | Chern |
| 5,793,027 | A | | 8/1998 | Baik |
| 5,796,834 | A | | 8/1998 | Whitney et al. |
| 5,803,748 | A | | 9/1998 | Maddrell et al. |
| 5,818,030 | A | | 10/1998 | Reyes |
| 5,818,930 | A | | 10/1998 | Mark |
| 5,825,871 | A | | 10/1998 | Mark |
| 5,834,747 | A | | 11/1998 | Cooper |
| 5,836,616 | A | | 11/1998 | Cooper |
| 5,837,546 | A | | 11/1998 | Allen et al. |
| 5,841,878 | A | | 11/1998 | Arnold et al. |
| 5,844,218 | A | | 12/1998 | Kawan et al. |
| 5,856,661 | A | | 1/1999 | Finkelstein et al. |
| 5,857,079 | A | | 1/1999 | Claus et al. |
| 5,861,602 | A | | 1/1999 | Cox et al. |
| 5,861,662 | A | | 1/1999 | Candelore |
| 5,884,271 | A | | 3/1999 | Pitroda |
| 5,889,267 | A | | 3/1999 | Robin et al. |
| 5,903,869 | A | | 5/1999 | Jacobson et al. |
| 5,910,987 | A | | 6/1999 | Ginter et al. |
| 5,914,657 | A | | 6/1999 | Chen |
| 5,916,024 | A | | 6/1999 | Von Kohorn |
| 5,934,789 | A | | 8/1999 | Sinclair et al. |
| 5,955,021 | A | | 9/1999 | Tiffany, III |
| 5,955,961 | A | | 9/1999 | Wallerstein |
| 5,961,451 | A | | 10/1999 | Reber et al. |
| 5,971,282 | A | | 10/1999 | Rollender et al. |
| 5,988,510 | A | | 11/1999 | Tuttle et al. |
| 6,003,769 | A | | 12/1999 | Ebbing |
| 6,012,049 | A | | 1/2000 | Kawan |
| 6,019,284 | A | | 2/2000 | Freeman et al. |
| 6,021,306 | A | | 2/2000 | McTaggart |
| 6,025,054 | A | | 2/2000 | Tiffany, III |
| 6,028,752 | A | | 2/2000 | Chomette et al. |
| 6,028,926 | A | | 2/2000 | Henderson et al. |
| 6,039,454 | A | | 3/2000 | Hallgrimsson |
| 6,041,215 | A | | 3/2000 | Maddrell et al. |
| 6,044,153 | A | | 3/2000 | Kaschke |
| 6,049,277 | A | | 4/2000 | Osame |
| 6,061,344 | A | | 5/2000 | Wood, Jr. |
| 6,064,988 | A | | 5/2000 | Thomas |
| 6,068,192 | A | | 5/2000 | McCabe et al. |
| 6,070,990 | A | | 6/2000 | Dalton et al. |
| 6,081,793 | A | | 6/2000 | Challener et al. |
| 6,089,451 | A | | 7/2000 | Krause |
| 6,104,280 | A | | 8/2000 | Tuttle et al. |
| 6,109,530 | A | | 8/2000 | Larson et al. |
| 6,109,762 | A | | 8/2000 | Hallgrimsson et al. |
| 6,129,277 | A | | 10/2000 | Grant et al. |
| 6,161,276 | A | | 12/2000 | Droz |
| 6,173,897 | B1 | | 1/2001 | Halpern |
| 6,176,010 | B1 | | 1/2001 | Droz |
| 6,176,430 | B1 | | 1/2001 | Finkelstein et al. |
| 6,184,788 | B1 | | 2/2001 | Middlemiss |
| 6,188,309 | B1 | | 2/2001 | Levine |
| 6,206,291 | B1 | | 3/2001 | Droz |
| 6,223,348 | B1 | | 4/2001 | Hayes |
| 6,230,003 | B1 | | 5/2001 | Macor |
| 6,236,724 | B1 | | 5/2001 | Labaton et al. |
| 6,239,976 | B1 | | 5/2001 | Templeton et al. |
| 6,241,153 | B1 | | 6/2001 | Tiffany, III |
| D444,465 | S | | 7/2001 | Do |
| 6,254,001 | B1 | | 7/2001 | Chan |
| 6,256,873 | B1 | | 7/2001 | Tiffany, III |
| 6,264,108 | B1 | | 7/2001 | Baentsch |
| 6,273,339 | B1 | | 8/2001 | Tuttle et al. |
| 6,282,186 | B1 | | 8/2001 | Wood, Jr. |
| 6,282,819 | B1 | | 9/2001 | Gu |
| 6,283,367 | B1 | | 9/2001 | Matthew et al. |
| 6,284,406 | B1 | | 9/2001 | Xing et al. |
| 6,289,324 | B1 | | 9/2001 | Kawan |
| 6,293,470 | B1 | | 9/2001 | Asplund |

6,297,789 B2 10/2001 Gauthier et al.
6,308,890 B1 10/2001 Cooper
6,349,829 B1 2/2002 Matheis et al.
6,352,604 B2 3/2002 Droz
6,353,811 B1 3/2002 Weissman
6,360,954 B1 3/2002 Barnardo
RE37,660 E 4/2002 Talton
6,372,307 B1 4/2002 Ji et al.
6,375,081 B1 4/2002 Hileman et al.
6,392,881 B1 5/2002 Saitoh
6,402,039 B1 6/2002 Freeman et al.
6,414,441 B1 7/2002 Fries et al.
6,435,695 B1 * 8/2002 Altman ..... 362/189
6,447,143 B2 9/2002 Krietzman et al.
6,454,435 B1 9/2002 Altman
6,459,376 B2 10/2002 Trosper
6,498,847 B1 12/2002 Henderson et al.
6,507,913 B1 1/2003 Shamir
6,533,436 B2 3/2003 Krietzman et al.
6,545,605 B2 4/2003 Van Horn et al.
6,547,984 B2 4/2003 Kobayashi et al.
6,553,244 B2 4/2003 Lesho et al.
6,563,563 B2 5/2003 Adams et al.
6,567,539 B1 5/2003 Benezeth
6,579,728 B2 6/2003 Grant et al.
6,591,524 B1 7/2003 Lewis et al.
6,592,031 B1 7/2003 Klatt
6,592,044 B1 7/2003 Wong et al.
6,604,685 B1 8/2003 Norton
6,607,127 B2 8/2003 Wong
6,607,136 B1 8/2003 Atsmon et al.
6,616,035 B2 9/2003 Ehrensvard et al.
6,619,553 B1 9/2003 Bobrov et al.
6,629,019 B2 9/2003 Legge
6,631,849 B2 10/2003 Blossom
6,641,050 B2 11/2003 Kelley et al.
6,679,970 B2 * 1/2004 Hwang ..... 156/277
6,693,513 B2 2/2004 Tuttle et al.
6,693,515 B2 2/2004 Clapper
6,705,520 B1 3/2004 Pitroda et al.
6,734,881 B1 5/2004 Will
6,739,505 B2 5/2004 Walker et al.
6,742,713 B1 6/2004 Trinkel
6,748,359 B1 6/2004 Colnot
6,753,830 B2 6/2004 Gelbman
6,753,880 B2 6/2004 Simoni et al.
6,758,404 B2 7/2004 Ladyansky
6,764,005 B2 7/2004 Cooper
6,769,607 B1 8/2004 Pitroda
6,769,618 B1 8/2004 Finkelstein
6,811,082 B2 11/2004 Wong
6,816,058 B2 11/2004 McGregor et al.
6,817,532 B2 11/2004 Finkelstein
6,840,455 B2 1/2005 Norton
6,854,657 B2 2/2005 Johnson
6,870,483 B1 3/2005 Davis
6,880,079 B2 4/2005 Kefford et al.
6,892,951 B2 5/2005 Goldenberg et al.
6,902,115 B2 6/2005 Graf et al.
6,902,116 B2 6/2005 Finkelstein
6,906,436 B2 6/2005 Jenson et al.
6,908,036 B2 6/2005 Koshimizu et al.
6,925,439 B1 8/2005 Pitroda
6,954,133 B2 10/2005 McGregor et al.
6,957,774 B1 10/2005 Sung
6,966,497 B1 11/2005 Hohmann et al.
6,971,581 B2 12/2005 Droz
6,986,965 B2 1/2006 Jenson et al.
6,991,155 B2 1/2006 Burchette, Jr.
7,003,495 B1 2/2006 Burger et al.
7,012,504 B2 3/2006 Tuttle et al.
7,025,277 B2 4/2006 Forrest et al.
7,036,730 B2 5/2006 Chung
7,036,740 B2 5/2006 Waters
7,051,929 B2 5/2006 Li
7,059,531 B2 6/2006 Beenau et al.
7,063,266 B2 6/2006 Goldenberg et al.
7,071,422 B2 7/2006 Droz
7,076,652 B2 7/2006 Ginter et al.
7,080,037 B2 7/2006 Burger et al.
7,083,083 B2 8/2006 Droz
7,083,094 B2 8/2006 Cooper
7,083,105 B2 8/2006 Maruyama et al.
7,090,123 B2 8/2006 Walker et al.
7,090,139 B2 8/2006 Kasuga et al.
7,097,108 B2 8/2006 Zellner et al.
7,150,406 B2 12/2006 Droz
7,183,929 B1 2/2007 Antebi et al.
7,228,651 B1 * 6/2007 Saari ..... 40/1.5
7,237,724 B2 7/2007 Singleton
7,260,221 B1 8/2007 Atsmon et al.
2001/0030863 A1 10/2001 Contant et al.
2002/0043566 A1 4/2002 Goodman et al.
2002/0116330 A1 8/2002 Hed et al.
2002/0153424 A1 10/2002 Li
2002/0170473 A1 11/2002 Fettis et al.
2002/0180584 A1 * 12/2002 McGregor et al. ..... 340/5.26
2002/0186131 A1 12/2002 Fettis et al.
2003/0019942 A1 1/2003 Blossom
2003/0107884 A1 6/2003 Krietzman et al.
2003/0123253 A1 7/2003 Krietzman et al.
2003/0132300 A1 * 7/2003 Dilday et al. ..... 235/487
2003/0132301 A1 * 7/2003 Selker ..... 235/487
2003/0155276 A1 * 8/2003 Gaffney et al. ..... 206/704
2003/0155425 A1 * 8/2003 Lynch ..... 235/492
2003/0201331 A1 10/2003 Finkelstein
2003/0209608 A1 11/2003 Blossom
2003/0220144 A1 11/2003 Brown
2003/0226899 A1 12/2003 Finkelstein
2004/0026495 A1 2/2004 Finkelstein
2004/0026506 A1 * 2/2004 Finkelstein ..... 235/449
2004/0035942 A1 2/2004 Silverman
2004/0040871 A1 * 3/2004 Kakinoki et al. ..... 206/307
2004/0041711 A1 3/2004 Loewidt
2004/0129787 A1 7/2004 Saito et al.
2004/0177542 A1 * 9/2004 Memelink ..... 40/661.08
2004/0236819 A1 11/2004 Anati et al.
2004/0238210 A1 12/2004 Droz
2004/0242270 A1 12/2004 Bhatt et al.
2005/0019989 A1 1/2005 Droz
2005/0020337 A1 1/2005 Simmons
2005/0036640 A1 2/2005 Goldenberg et al.
2005/0044756 A1 3/2005 Abrahams
2005/0046175 A1 * 3/2005 Fox ..... 283/75
2005/0085005 A1 4/2005 Droz
2005/0092830 A1 5/2005 Blossom
2005/0227214 A1 10/2005 Clegg
2005/0242193 A1 * 11/2005 Smith et al. ..... 235/487
2005/0247777 A1 11/2005 Pitroda
2005/0263596 A1 12/2005 Nelson et al.
2006/0003824 A1 1/2006 Kobayashi et al.
2006/0032906 A1 2/2006 Sines
2006/0080545 A1 4/2006 Bagley
2006/0108429 A1 5/2006 Waters
2006/0124350 A1 6/2006 Droz
2006/0131396 A1 6/2006 Blossom
2006/0136544 A1 6/2006 Atsmon et al.
2006/0148404 A1 7/2006 Wakim
2006/0156385 A1 7/2006 Chiviendacz et al.
2006/0157553 A1 7/2006 Kelley et al.
2006/0157555 A1 7/2006 Dean et al.
2006/0157556 A1 7/2006 Halbur et al.
2006/0161439 A1 7/2006 Selg et al.
2006/0162156 A1 7/2006 Reed
2006/0172458 A1 8/2006 Droz
2006/0186212 A1 8/2006 Cooper
2006/0226237 A1 10/2006 Droz

FOREIGN PATENT DOCUMENTS

KR 10-2004-0069955 8/2004
WO WO 01/82248 11/2001
WO WO 01/82661 11/2001
WO WO 2006/080929 8/2006
WO WO 2006/087435 8/2006
WO WO 2006/101493 9/2006

OTHER PUBLICATIONS

International Search Rpt. & Written Opinion, Apr. 7, 2008.
Evors, J., "A password for your credit Cards", http://www.news.com (2006).
Dkretta, D., "Hallmark Rocks Out"; Express (2006).
Svoboda, E., "Charging Ahead", Popular Science (2007).
International Search Report & Written Opinion, Jun. 4, 2008.

* cited by examiner

MAILING APPARATUS FOR POWERED CARDS

This application claims the benefit of U.S. Provisional Application No. 60/877,634, filed Dec. 29, 2006, which is herein incorporated by reference in its entirety.

BACKGROUND

1. Field of the Invention

The present invention relates generally to powered ISO 7816-compliant cards and, more particularly, to apparatus for mailing powered cards in compliance with applicable postal regulations.

2. Background of the Invention

As a convenience for their customers, businesses (e.g., financial institutions), retailers, and advertisers routinely deliver transactional cards and promotional cards to their customers through the mail. The convenience of receiving a card through the mail saves a customer the trouble of visiting a retail location to pick up a card. As a result, the United States Postal Service ("USPS") annually handles the mailing of millions of transactional cards, such as credit cards, debit cards, electronic cash cards, gift cards, pre-paid calling cards, Internet access cards, membership cards, identification cards, and smart cards.

Recently, card makers have developed ISO-compliant, self-powered cards, in which batteries, circuitry, and electronic components are embedded. The electronic components give the cards additional functionality, providing features such as sound, lights, and alphanumeric displays for secure token value generation. Powered cards having such features are produced by Innovative Card Technologies of Los Angeles, Calif. and are described, for example, in U.S. Pat. Nos. 5,412,199; 5,434,405; 5,608,203; 5,856,661; 6,176,430; and 6,902,116, which are herein incorporated by reference in their entirety.

Powering the cards, however, has introduced difficulties in complying with USPS postal regulations, which dictate that any device powered by dry-cell batteries must have the batteries removed or deactivated to prevent activation of the device in the mail.

SUMMARY OF THE INVENTION

In accordance with an embodiment of the present invention, a mailing apparatus is provided for maintaining an electronically powered card in a deactivated state. The apparatus includes a housing having a face panel and two side panels attached to the face panel at opposite sides. The side panels extend from the face panel in a direction generally perpendicular to the face panel. The apparatus further includes an electronically powered card that has an activation device on a surface thereof and an offset mechanism that establishes an offset distance between the electronically powered card and the face panel so that a force exerted upon the face panel is resisted by the face panel and prevented from causing activation of the activation device of the card.

In accordance with another aspect of the present invention, a mailing apparatus is provided for maintaining an electronically powered card in a deactivated state. The apparatus includes an electronically powered card that has an activation device on a surface and a prevention element attached to the surface of the electronically powered card. The prevention element is disposed around the activation device and is raised above the surface of the card. The prevention element has a thickness sufficient to prevent the activation of the activation device when a force is applied to a planar substrate disposed over the prevention element in a direction generally perpendicular to the planar substrate.

In accordance with another aspect of the prevent invention, a method of packaging and maintaining an electronically powered card in a deactivated state is provided. In the method, a housing is provided that has a face panel and two side panels attached to opposite sides of the face panel and an electronically powered card is inserted into the housing so that an offset distance is established between the face panel and all activation device located on a surface of the card facing the face panel. The housing with the inserted electronically powered card is mailed. The housing and the card have an interface that establishes the offset distance between the face panel and the activation device during transport so that the activation device is not activated by a force exerted on the face panel in a direction generally perpendicular to the face panel.

In accordance with another aspect of the prevent invention, a method of packaging and maintaining an electronically powered card in a deactivated state is provided. In the method, a prevention element is adhered onto an electronically powered card. The electronically powered card has an activation device on a surface thereof and the prevention element is disposed adjacent the activation device. The electronically powered device and adhered prevention element is inserted into an envelope or mailing container and the envelope or mailing container is mailed with the electronically powered card and adhered prevention element inserted therein. The prevention element has a thickness sufficient to prevent the activation of the activation device when a force is applied to an envelope or mailing container disposed over the prevention element during transport in a direction generally perpendicular to the activation device.

Figure 1:
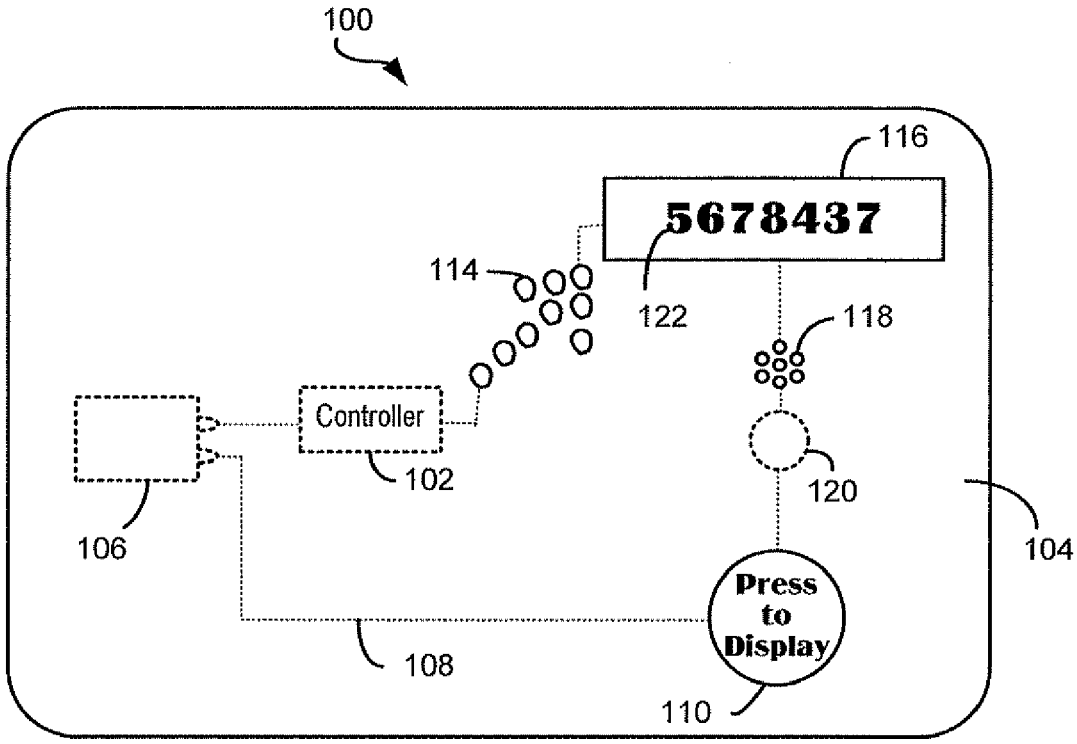
FIG. 1 is a schematic diagram of a powered card according to an embodiment of the present invention.

For clarity and ease of understanding, the components shown in the figures are not drawn to scale.

DETAILED DESCRIPTION

Embodiments of the present invention provide a mailing apparatus for a powered card. The mailing apparatus prevents activation of the powered card during mailing.

An exemplary powered card comprises a thin, flexible substrate (e.g., paper, thin cardboard stock, or plastic) having an embedded battery and electrical circuitry. The powered card is preferably equal in size to a conventional credit card, and may meet at least the flexibility requirements of ISO 7816. Powered by the battery, the circuitry can activate electronic output devices that, for example, display an encrypted light array, display alphanumeric characters or graphics, or play a voice message. From this output, a user can obtain information necessary to complete a transaction, for example, authenticating access to a financial account. The card can be branded or printed and may be traded, collected, or distributed as part of a promotion.

The electrical circuitry can be activated by any means suitable for a particular application. For example, the circuitry can be activated by light sensors, audio sensors, motion sensors, wireless sensors, or mechanical switches (e.g., membrane switches). With light, audio, and motion, the powered card would be activated when the appropriate stimulus is received. With wireless sensors using, for example, radio frequency identification (RFID), Bluetooth™, WiFi, or near frequency communication (NFC) technology, the powered card would be activated by the appropriate wireless signal. With mechanical switches, the powered card can be, for example, activated by a user's pressing a button or multiple buttons, or by a sliding a switch. In some applications, a user-actuated mechanical switch may be preferred to save power and extend the shelf life of the powered card.

In an embodiment of the present invention, the circuitry and battery of a powered card is capable of insertion into a substrate equal in size to a conventional credit card, and meets at least the flexibility requirements of ISO 7816. An appropriate flexible battery for such an apparatus is available from Solicore (Lakeland, Fla.), which produces batteries using polymer matrix electrolyte (PME). The batteries are ultra-thin, flexible, environmentally friendly, and safe, and preferably having the following characteristics:

- low profile design—approximately 0.3 mm thick; flexible and will not break or crack when bent or flexed;
- conformable, in that the electrolyte can be a solid, non-compressible film, which can be shaped and formed into a variety of designs;
- compatible with high speed printing and binding processes, and card manufacturing processes, and can survive hot lamination processes;
- operable over a wide temperature range (−20° C. to +60° C.);
- offer high ionic conductivity over a broad temperature range;
- feature low self discharge rates (less than 1% per month);
- provide high energy density (up to 300 Wh/l), thus offering maximum performance in smallest packages;
- possess self connecting terminals;
- are non-toxic, disposable, and environmentally friendly;
- contain solid polymer electrolyte—no volatile liquids or gelling agents;
- offer overall safety: with no out-gassing, swelling, or thermal runaway; no need for added safety devices; and pass UL requirements for crush test, drop test, and nail test; and
- enjoy an inherently safe design, which reduces the need for additional battery safety circuitry.

The circuitry of the powered card includes at least one electronic output device that provides the user with information, such as a token value necessary for authentication. For example, the electronic output device can display an encrypted light array, alphanumeric characters, or a graphic, or can play a voice message. The user would then use the information for the purpose of authentication to obtain access to an associated system, such as a banking system or online game system.

FIG. 1 illustrates a powered card 100 according to an embodiment of the present invention. As shown, card 100 comprises a substrate 104, a battery 106, and circuitry 108. Substrate 104 can be paper or any other thin flexible material. Battery 106 and circuitry 108 are embedded in substrate 104 (e.g., sandwiched between a front and back face of substrate 104), as represented by the dashed lines. Circuitry 108 includes a controller 102, which may include, for example, a token value generator, a microprocessor, memory, clock, and any other necessary circuitry or devices. Circuitry 108 is controlled by a switch 110, such as a press button. Alternatively, circuitry 108 could be controlled by a light, audio, or motion sensor. Circuitry 108 also includes one or more electronic output devices that are activated when circuitry 108 is powered. For example, circuitry 108 can include an illumination device 114, a display 16, a speaker 118, and/or a vibrator 120.

As one of ordinary skill in the art would appreciate, circuitry 108 is shown only for illustration purposes and could include differently configured wires or conductive traces. For example, conductors to the illumination device 114 could be individually connected to each of the illumination elements (e.g., each LED or each electroluminescent device), or connected collectively such that the elements could be illuminated in unison, or some combination thereof. Similarly, if an alphanumeric or graphic display is used, the circuitry can be configured to drive the individual elements thereof in accordance with any desired sequence or design.

In one embodiment, substrate 104 comprises front and back faces made from cardstock and adhered together using adhesive. Battery 106, circuitry 108, and the other components are all sufficiently thin and flexible that the powered card has the same "feel" as a conventional cardstock playing card.

In another embodiment, substrate 104 comprises front and back faces made from plastic sheeting, similar to that used for a credit card-sized ISO 7816 compliant card. Optionally, thinner layers of plastics can be used to allow for increased flexibility.

In operation, powered card 100 activates in response to completion of circuitry 108, which provides power from battery 106 to the electronic output devices. In this example, circuitry 108 is completed by pressing button 110. Alternatively, another mechanical switch, such as a slide switch, could be used to activate card 100.

Once circuitry 108 is closed, controller 102 and circuitry 108 activate one or more electronic output devices 114, 116, 118, and 120. For example, controller 102 and circuitry 108 can light illumination device 114 in a particular pattern that reveals a code, can display an alphanumeric message or graphic 122 on display 116, can play a sound, a message, or music through speaker 118 (e.g., a voice stating a code), or can activate vibrator 120 in a pattern that reveals a code. Illumination device 114 can comprise, for example, LED lights, incandescent lights, or electroluminescent devices. Display 116 can comprise, for example, an LCD screen, an electroluminescent display (such as those produced by Philips Electronics of Amsterdam; Sharp of Osaka, Japan; or Planar Systems, Inc. of Beaverton, Oreg.), or a printable electronic ink (such as those produced by E Ink of Cambridge, Mass., or Xerox of Palo Alto, Calif.). Speaker 118 can comprise, for example, a miniature speaker suitable for tight form factor applications. Vibrator 120 can comprise, for example, a miniature vibrator suitable for tight form factor applications, such as applications involving pagers and cellular telephones.

Figure 2A:
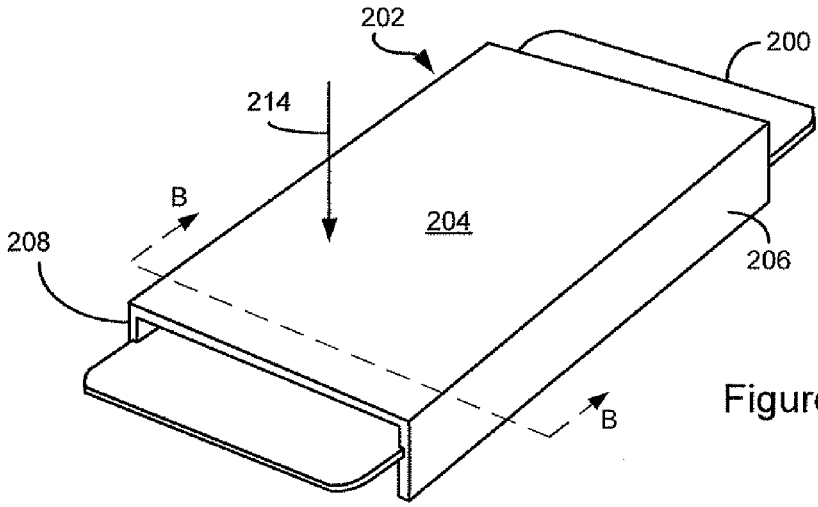
FIG. 2A is a schematic diagram of a perspective view of a powered card and a mailing apparatus, with the mailing apparatus having slots that receive the powered card, according to an embodiment of the present invention.
Figure 2B:
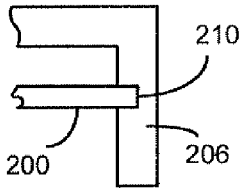
FIG. 2B is a schematic diagram of a partial cross-sectional view of the powered card and mailing apparatus of FIG. 2A, taken along line B-B.
Figure 2C:
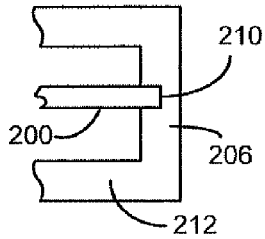
FIG. 2C is a schematic diagram of a partial cross-sectional view of a powered card and mailing apparatus, with the mailing apparatus having a front panel, a back panel, and two side panels, and having slots that receive the powered card, according to an embodiment of the present invention.
Figure 2D:
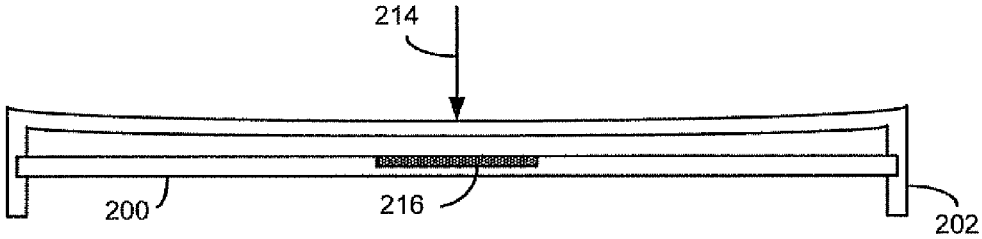
FIG. 2D is a schematic diagram of a cross-sectional view of the powered card and mailing apparatus of FIG. 2A taken along line B-B and showing a force applied to the mailing apparatus, according to an embodiment of the present invention.

FIGS. 2A-2D illustrate a powered card 200 and mailing apparatus 202 according to an embodiment of the present invention. As shown, mailing apparatus 202 is a sleeve that includes a face panel 204 and two side panels 206, 208. Side panels 206 have slots 210 into which the edges of the powered card 200 slide, thereby holding the front face of the card 200 at a fixed distance from the underside of face panel 204. Mailing apparatus 202 is sufficiently rigid enough to retain card 200 within slots 210, and can optionally include a second face panel 212 opposing face panel 204 to provide a desired rigidity, as is shown in FIG. 2C. In addition, face panel 204 is itself sufficiently rigid enough to resist a force (especially a point force) in the general direction of arrow 214, to prevent a switch on the face of card 200 from being activated. As one example, FIG. 2D illustrates face panel 204 yielding slightly to the force 214, but not allowing contact with switch 216. Although shown as not contacting switch 216, the flexibility of face panel 204 could allow some degree of contact, as long as the force 214 is sufficiently dissipated or distributed to prevent actuation of switch 216. The degree to which the face panel 204 can contact switch 216 or any other portion of the face of panel 204 would of course depend on, for example, the type and sensitivity of the switch. Mailing apparatus 202 could be made of plastic, such as ABS or PVC.

Although FIG. 2A depicts the mailing apparatus 202 covering a majority of the card 200, mailing apparatus 202 could cover any appropriate length of the card 200 depending on, for example, the location of switches or other electronic components that should not be activated or damaged during mailing. As an example, if only a small switch need be covered, then mailing apparatus 202 could be a narrow band spanning the width of card 202, with the band just wide enough to cover the small switch.

Figure 3:
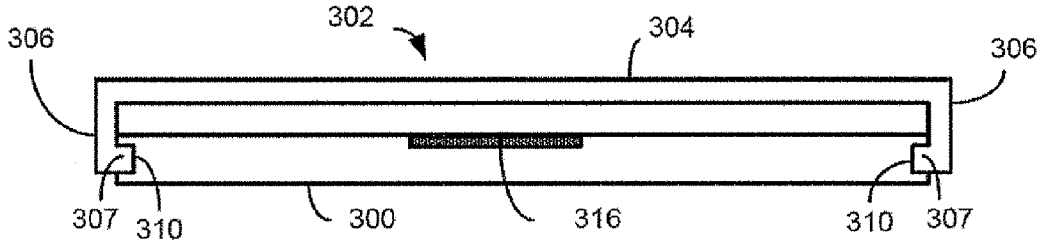
FIG. 3 is a schematic diagram of a cross-sectional view of a powered card and a mailing apparatus, with the card having slots that receive protrusions of the mailing apparatus, according to an embodiment of the present invention.

FIG. 3 illustrates a powered card 300 and mailing apparatus 302 according to another embodiment of the present invention. As shown, card 300 defines slots 310 in two of its opposing edges. Mailing apparatus 302 includes a face panel 304, two opposing side panels 306, and two opposing protrusions 307 protruding from side panels 306. Protrusions 307 are adapted to slide within slots 310. In this position, the face panel 304 of mailing apparatus 302 is disposed over and spaced apart from the front face of card 300 and its switch 316. Face panel 304 resists forces applied in a direction generally perpendicular to the front face of card 300, as described above with reference to FIGS. 2A-2D.

Figure 4A:
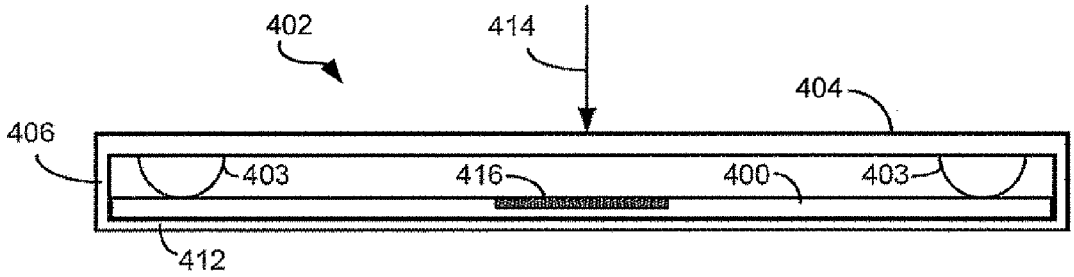
FIG. 4A is a schematic diagram of a cross-sectional view of a powered card and a mailing apparatus, with the mailing apparatus having interior protrusions, according to an embodiment of the present invention.

FIG. 4A illustrates a powered card 400 and mailing apparatus 402 according to another embodiment of the present invention. As shown, mailing apparatus 402 is a sleeve that includes a face panel 404, two side panels 406, and a back panel 412. The underside of face panel 404 has one or more protrusions 403 located and adapted to contact portions of the front face of card 400 that do not affect the operation of the card 400 (e.g., areas of the face away from switch 416). The card 400 is held in place in the interior of mailing apparatus 402, with the face panel 404 disposed over and spaced apart from the front face of card 400 and its switch 416. In this position, face panel 404 resists forces applied in a direction generally perpendicular to the front face of card 400, as described above with reference to FIGS. 2A-2D.

Figure 4B:
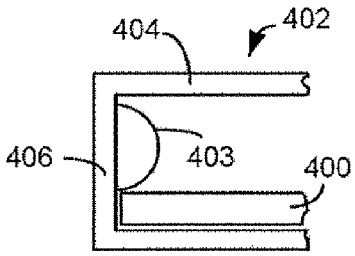
FIG. 4B is a schematic diagram of a partial cross-sectional view of a powered card and a mailing apparatus, with the mailing apparatus having an interior protrusion protruding from its side panel, according to an embodiment of the present invention.
Figure 4C:
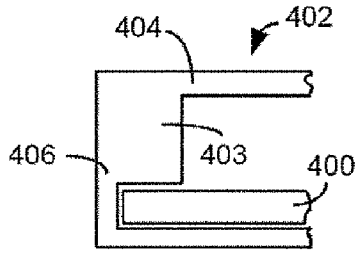
FIG. 4C is a schematic diagram of a partial cross-sectional view of a powered card and a mailing apparatus, with the mailing apparatus having an interior protrusion protruding from its face panel and a side panel, according to an embodiment of the present invention.

Although FIG. 4A depicts the cross-sectional shape of protrusions 403 as round, protrusions 403 could have other cross-sectional shapes such as a rectangle, square, or triangle. In addition, protrusions 403 could be isolated protrusions on the underside of face panel 404, or could be continuous rails along the length of mailing apparatus 402. In one embodiment, mailing apparatus 402 has one isolated protrusion in each of the four corners of face panel 404. In another embodiment, mailing apparatus 402 has two continuous rails, each having a rectangular cross-section, with one disposed proximate to a side panel 406 and the other disposed proximate to the opposite side panel 406. In another embodiment, as shown in FIG. 4B, a protrusion 403 protrudes from a side panel 406 of mailing apparatus 402, holding an edge of card 400. In another embodiment, as shown in FIG. 4C, a protrusion 403 protrudes from both a side panel 406 and the face panel 404, for example, filling the corner of mailing apparatus 402 and holding an edge of card 400.

Figure 4D:
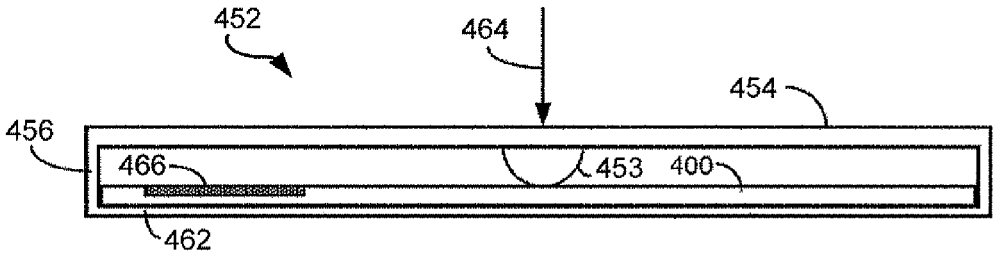
FIG. 4D is a schematic diagram of a partial cross-sectional view of a powered card and a mailing apparatus, with the mailing apparatus having a single interior protrusion, according to an embodiment of the present invention.

Although FIG. 4A shows the use of multiple protrusions, an alternative embodiment of the present invention provides only one protrusion, an example of which is shown in FIG. 4D. In this exemplary configuration, mailing apparatus 452 has a single protrusion 453, which can be, for example, an isolated round protrusion in the center of the face panel 454 of mailing apparatus 452. The mailing apparatus 452 has side panels 456 and back panel 462 having similar characteristics as previously described side panels 406 and back panel 412. The protrusion 453 may alternatively be a continuous round protrusion (e.g., shaped like a road speed bump) extending the length of mailing apparatus 452 along the center of face panel 454. The protrusion 453 is preferably located to contact the face of card 400 in an area apart from switch 466. In this manner, protrusion 453 prevents a force 464 applied in a direction generally perpendicular to face panel 452 from deflecting face panel 452 against switch 466 and activating switch 466.

An alternative embodiment of the present invention provides a mailing apparatus, such as the mailing apparatus 402, with a closed end. In other words, rather than having a sleeve with two open ends, this alternative embodiment provides a closed end to form a pocket. In this manner, a powered card can be inserted into the pocket sleeve, with the sleeve covering only a portion of the card (e.g., one-third of the card starting from an end). The pocket sleeve could have protrusions or slots as described above, to prevent activation of a switch or other electronic component.

Figure 5A:
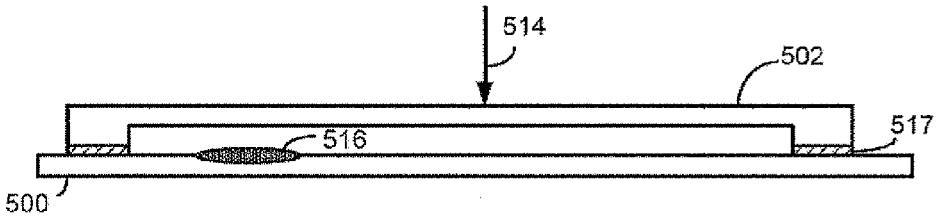
FIG. 5A is a schematic diagram of a cross-sectional view of a powered card and a mailing apparatus, with the mailing apparatus attached to a face of the card, according to an embodiment of the present invention.
Figure 5B:
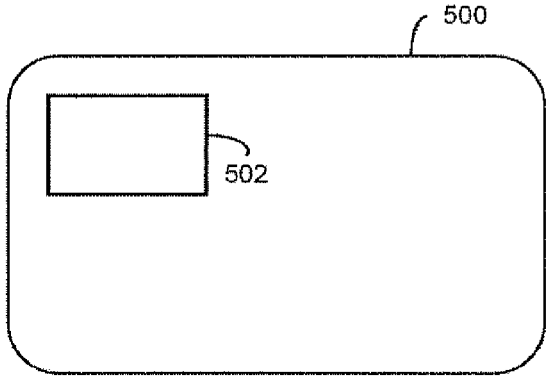
FIG. 5B is a schematic diagram of a powered card and a mailing apparatus, with the mailing apparatus covering only a portion of a face of the card, according to an embodiment of the present invention.

FIG. 5A illustrates a cross-sectional view of a powered card 500 and mailing apparatus 502 according to another embodiment of the present invention. As shown, mailing apparatus 502 is attached to the face of card 500 oh which a switch 516 is disposed, providing a cover over the switch. In this manner, mailing apparatus 502 resists a force 514 applied in a direction generally perpendicular to the front face of card 500, similar to the embodiments described above with reference to FIGS. 2A-2D. In this example, mailing apparatus 502 is attached to card 500 by a layer of adhesive 517, which is strong enough to hold the mailing apparatus 502 to the card 500 during mailing, but can be conveniently released by the user after mailing so that the card 500 can be used. Although FIG. 5A shows the mailing apparatus 502 covering a majority of the width of card 500, mailing apparatus 502 could cover any portion of the width or length of card 500, depending on the location of the components of card 500. For example, as shown in FIG. 5B, if a switch is located in only one small portion of the face of card 500, mailing apparatus 502 could be placed over only the switch, leaving the remaining portion of the face of the card 500 uncovered.

Figure 6A:
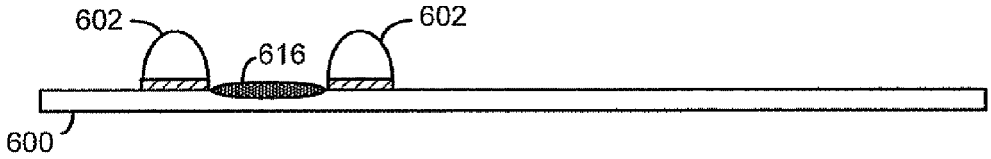
FIG. 6A is a schematic diagram of a cross-sectional view of a powered card and a mailing apparatus, the mailing apparatus comprising one or more projections adhered to a face of card proximate to the switch, according to an embodiment of the present invention.
Figure 6B:
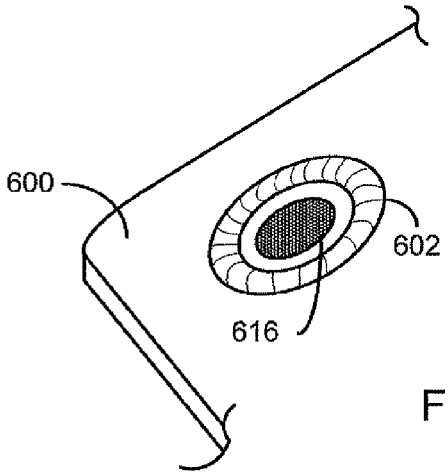
FIG. 6B is a schematic diagram of a partial perspective view of the powered card and mailing apparatus of FIG. 6A.

FIGS. 6A and 6B illustrate a further embodiment of the present invention, in which the mailing apparatus 602 comprises one or more projections adhered to the face of card 600 proximate to the switch 616. The projections 602 help prevent structures, such as the paper of the envelope in which card 600 is mailed, from contacting switch 616 and activating card 600. Although shown as doughnut-shaped, mailing apparatus 602 could comprise other shaped projections, such as individual raised bumps placed around the switch.

Figure 7:
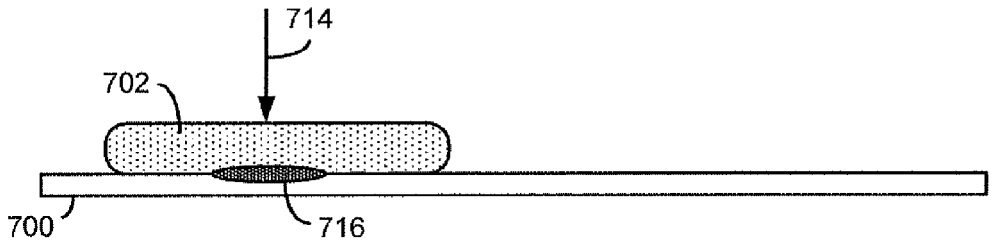
FIG. 7 is a schematic diagram of a cross-sectional view of a powered card and a mailing apparatus, the mailing apparatus comprising a compressible release liner adhered to a face of card, according to an embodiment of the present invention.

FIG. 7 illustrates a cross-sectional view of a powered card 700 and mailing apparatus 702 according to another embodiment of the present invention. In this configuration, mailing apparatus 702 comprises a compressible release liner that is adhered to the face of card 500 over the switch 716. Mailing apparatus 702 is made of a material having properties (e.g., hardness, compressibility, and thickness) sufficient to resist the typical forces 714 encountered during mailing, applied generally in a direction perpendicular to the face of card 700. For example, mailing apparatus 702 could be made of a compressible foam or a compressible gel. Alternatively, mailing apparatus 702 could comprise a chamber filled with a liquid or a gas. In this manner, mailing apparatus 702 can dissipate or distribute forces 714 so that switch 716 is not actuated. In one configuration, mailing apparatus 714 is attached to the face of card 700 by a layer of adhesive that is strong enough to hold the mailing apparatus 702 to the card 700 during mailing, but can be conveniently removed by the user after mailing so that the card 700 can be used.

Embodiments of the present invention therefore provide mailing apparatus that prevent activation of a powered card during mailing, to comply with applicable postal regulations. The mailing apparatus can be temporarily applied to a powered card for mailing, and then conveniently removed by the user so that the powered card can be activated and used. In addition, embodiments of the present invention are inexpensive and conveniently incorporated into high volume printing, card-making, and mailing operations.

Although embodiments of the present invention describe mailing apparatus with respect to powered cards having mechanical switches such as membrane switches, the mailing apparatus of the present invention are equally applicable to other switches, such as sound-activated or light-activated switches. For example, the mailing apparatus 702 of FIG. 7 could be used to seal a light sensor, wireless sensor, or sound sensor that is used to activate a powered card. In this manner, when the user removes mailing apparatus 702 from card 700, the card is activated, for example, illuminating lights and displays to convey a mailed advertisement. In the case of a wireless sensor, the mailing apparatus could be made of an electromagnetically opaque material to act as a shield, preventing wireless signals from activating the card during mailing.

In one implementation, the powered card and the mailing apparatus are branded (e.g., with graphics, logos, colors, or holography) to associate the card and mailing apparatus with each other and/or with a system to which the card provides access. The powered cards and mailing apparatus may be disposable (in that they may have limited temporal use) or may be intended to be collectors' items.

The powered cards and mailing apparatus in accordance with the present invention may be given away free, given away as part of a related promotion, given as a gift with a purchase of an unrelated item, included in the packaging of a video game, or made available for purchase on their own as products in their own right.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A mailing apparatus for maintaining an electronically powered card in a deactivated state, comprising:

an electronically powered card having an activation device on a surface thereof, wherein the activation device is a mechanical switch;

a prevention element attached to the surface, the prevention element disposed adjacent the activation device and raised above the surface of the electronically powered card;

wherein the prevention element is an annular projection on the surface of the card in an area surrounding the activation device; and wherein the prevention element has a thickness sufficient to prevent the activation of the activation device when a force is applied to a planar substrate disposed over the prevention element in a direction generally perpendicular to the planar substrate.

2. The mailing apparatus of claim 1, wherein the prevention element is a compressible release liner that is adhered to the surface of the card.

3. The mailing apparatus of claim 2, wherein the compressible release liner comprises a foam or a gel.

4. The mailing apparatus of claim 2, wherein the compressible release liner comprises a chamber filled with one of a liquid or a gas.

5. A method of packaging and maintaining an electronically powered card in a deactivated state, comprising:

adhering a prevention element onto an electronically powered card, the electronically powered card having an activation device on a surface thereof, wherein the prevention element is disposed adjacent the activation device, and wherein the activation device is a switch;

inserting the electronically powered device and adhered prevention element into an envelope or mailing container;

mailing the envelope or mailing container with the electronically powered card and adhered prevention element inserted therein, wherein the prevention element has a thickness sufficient to prevent the activation of the activation device when a force is applied to a container disposed over the prevention element during transport in a direction generally perpendicular to the activation device; and wherein the prevention element as an annular projection on the surface of the card in an area surrounding the activation device.

6. The method of claim 5, wherein the prevention element is a compressible release liner that is adhered to the surface of the card.

7. The method of claim 6, wherein the compressible release liner comprises a foam or gel.

8. The method of claim 6, wherein the compressible release liner comprises a chamber filled with one of a liquid or a gas.

9. The method of claim 1, wherein the prevention element is disposed adjacent to the activation device so as not to cover or contact the activation device.

10. The mailing apparatus of claim 1, wherein the prevention element comprises individual raised projections placed around the activation device.

11. The mailing apparatus of claim 1, wherein the mechanical switch comprises one or more buttons, a slide switch or a membrane switch.

12. The method of claim 5, wherein the prevention element comprises individual raised projections placed around the activation device.

13. The method of claim 5, wherein the mechanical switch comprises one or more buttons, a slide switch or a membrane switch.

* * * * *